United States Patent [19]

Hood

[11] 4,346,563

[45] Aug. 31, 1982

[54] SUPER CRITICAL HELIUM REFRIGERATION PROCESS AND APPARATUS

[75] Inventor: Charles B. Hood, Columbus, Ohio

[73] Assignee: CVI Incorporated, Hilliard, Ohio

[21] Appl. No.: 266,573

[22] Filed: May 15, 1981

[51] Int. Cl.[3] ..... F25B 5/00

[52] U.S. Cl. ..... 62/117; 62/38; 62/514 R

[58] Field of Search ..... 62/514 R, 513, 9, 38, 62/39, 40, 117

[56] References Cited

U.S. PATENT DOCUMENTS

| | | | |
|---|---|---|---|
| 3,611,740 | 10/1971 | Giger | 62/514 R |
| 3,613,387 | 10/1971 | Collins | 62/514 R |
| 4,048,814 | 9/1977 | Quack | 62/514 R |
| 4,161,107 | 7/1979 | Korsakov et al. | 62/117 |
| 4,189,930 | 2/1980 | Davydov et al. | 62/514 R |
| 4,267,701 | 5/1981 | Toscano | 62/514 R |

*Primary Examiner*—Ronald C. Capossela

*Attorney, Agent, or Firm*—Seidel, Gonda, Goldhammer & Panitch

[57] ABSTRACT

A closed loop refrigeration process and apparatus provides a large flow of cold, supercritical gas through a device which is to be cooled at cryogenic temperatures. The output of helium gas from a compressor is precooled with liquid nitrogen and divided into two streams which are cooled by expansion and by heat exchange with the return flow of helium to the compressor. The two streams are recombined and further cooled by heat exchange with the return flow and a liquid helium bath. The entire output of the compressor, at liquid helium temperature and above critical pressure, is forced through the load. The stream is then expanded through a valve where partial liquefaction takes place to replenish the liquid helium cooling bath. Gaseous helium is drawn off from the liquid helium bath and recycled through the heat exchangers back to the compressor.

10 Claims, 2 Drawing Figures

SUPER CRITICAL HELIUM REFRIGERATION PROCESS AND APPARATUS

BACKGROUND OF THE INVENTION

This invention relates generally to ultra low temperature refrigeration and more specifically to a closed loop, supercritical helium gas refrigeration process and apparatus.

Present technology includes two general methods for the cooling of ultra low temperature devices, such as super conducting magnets, generators, and cryopumps. One method uses liquid helium and allows the helium to boil within the device to maintain a constant temperature. The other method is to force flow a stream of supercritical gas at low temperature through the device. The second method has the advantage of providing greater flexibility of design but is limited by the fact that a temperature rise occurs as the cooling stream flows through the device. This is in contrast to the constant temperature provided by the isothermal boiling of liquid helium. The temperature rise can be reduced by increasing the flow, but the flow required to do so is much higher than can be provided by the conventional helium refrigerator. One approach to provide increased flow has been the use of a circulating loop with a cold circulating pump at liquid helium temperature. This has the disadvantages of considerable complexity plus the need to increase the size of the refrigerator in order to remove the heat generated by the circulating pump.

U.S. Pat. No. 4,161,107 discloses a method of producing low temperatures in which the output of helium gas from a compressor is split into two streams which are stepwise cooled by the return flow. The main stream and at least a portion of the subsidiary stream are liquified and used to sustain a refrigerative load. The liquid evaporates as heat is removed. Such a pool boiling or evaporative technique requires a phase change before being passed through the load and cooling cans surrounding the load to hold the boiling helium. The need for such cooling cans makes the use of this system impractical, or at best, complex where the size and/or geometry of the load requires a series of such cooling cans. With the need for liquid helium refrigerator systems having a large capacity for present as well as future technologies, such as nuclear fusion, there is a need to combine the advantages of increased cooling capacity and the flexibility of design of a supercritical gas refrigeration method with the constant temperature cooling of the evaporative method.

BRIEF SUMMARY OF THE INVENTION

In accordance with this invention there is provided a closed loop, supercritical gas refrigeration apparatus which comprises a. Compressor means to compress a supply of gaseous material to superatmospheric pressure and to force the compressed gaseous material through a refrigerative load, b. high pressure fluid flow path means to convey substantially all of the compressed gaseous material from the compressor to the refrigerative load, said path means including:

(1) means to divide the gaseous material into two streams, (2) means to expand the gaseous material in each stream, (3) means to recombine the two streams, and (4) means to pass the gaseous material through a cooling bath and the refrigerative load, c. means to expand and liquify a portion of the gaseous material after it has passed through the refrigerative load, d. means to introduce the liquid portion of the material into the cooling bath, e. low pressure fluid flow path means to return the expanded gaseous material from above the liquid portion of the material in the cooling bath to the compressor, and f. heat exchange means arranged to provide heat transfer from the gaseous material flowing in the high pressure fluid flow path means to the gaseous material flowing in the low pressure fluid flow path means, such that the combination of the cooling of the gaseous material in the high pressure fluid flow path by expansion, by heat exchange and by the cooling bath forms a stream of cold, supercritical gas which is passed through the refrigerative load.

Also provided is a supercritical gas refrigeration process which comprises:

(a) compressing a gas to form a gaseous feed stream at superatmospheric pressure, (b) stepwise cooling the feed stream by heat exchange with a return stream of the gas, (c) splitting the feed stream into two streams in the course of the stepwise cooling, and expanding the gas in each stream to provide for the cooling of the gas while maintaining the gas at supercritical pressure, (d) recombining the two streams at about the same temperature and pressure and passing the recombined feed stream through a cooling bath of the liquid gas so as to further cool the gaseous feed stream, (e) forcing substantially all of the cold, gaseous feed stream at supercritical pressure through a refrigerative load using the force provided by the initial compression, (f) expanding the feed stream after passing through the load to partially liquify the gas in the feed stream, (g) feeding the liquified gas to the cooling bath, and removing gas from above the bath to the return stream for compression and return to the feed stream.

DETAILED DESCRIPTION

Figure 1:
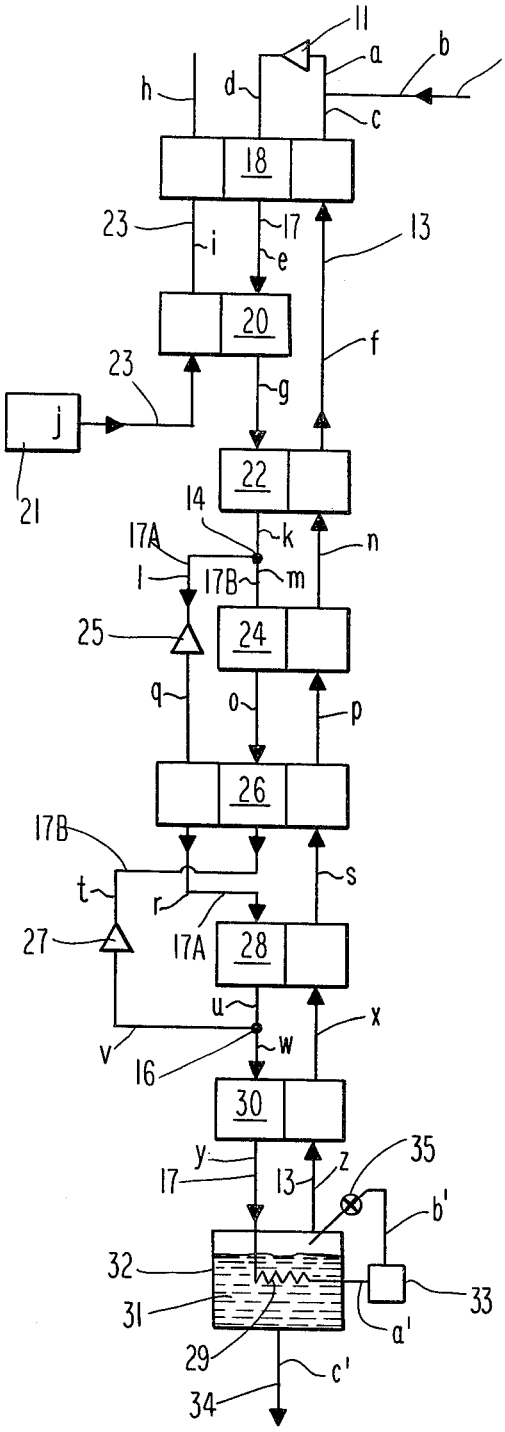
FIG. 1 is a schematic diagram illustrating an embodiment of the refrigeration apparatus of the invention.

Turning now to FIG. 1, compressor 11, for example an oil lubricated screw or a reciprocating compressor as are commonly used in the refrigeration industry, is provided with gaseous helium from return line 13. Compressor 11 compresses the gas to a pressure of from about 15 to 25 atmospheres. Additional helium is added from a supply (not shown) through line 15 to provide the initial charge to the refrigeration apparatus and to make up for losses during operation and a liquid withdrawn at 34. A high pressure flow path is provided by line 17 which passes through heat exchangers 18, 20 and 22 which are, for example, either of the aluminum plate fin type or the coil type. The helium is precooled in the heat exchangers by gaseous helium in return line 13 and by liquid nitrogen from supply 21 flowing in line 23 which is vented to the atmosphere. The use of nitrogen cooling is optional. Also, an expander could be used in place of the nitrogen cooling in heat exchanger 20. The high pressure flow path is then split at point 14 into two lines 17A and 17B. The flow in each line is controlled by the size of the sonic orifices of expanders 25 and 27. A valve (not shown) can be used to fine tune the flow in each line. Line 17A is connected to expander 25 which is, for example, a turboexpander with gas or oil lubricated bearings. After expander 25, line 17A passes through heat exchangers 26 and 28, for example, of the aluminum fin type, before rejoining line 17B at point 16. Line 17B passes through heat exchangers 24 and 26 and is connected to expander 27 which can be of the same type as expander 25. Line 17 then passes through heat exchanger 30 and into subcooling coil 29 which is immersed in liquid helium 31 contained in bath 32. Liquid helium optionally can be removed from the bottom of bath 32 through line 34 such as to provide auxiliary cooling of a load, for example, the current leads of a superconducting magnet. Line 17 passes the gaseous helium at supercritical pressure (above 2.25 atm.) through a refrigerative load 33, for example superconducting magnets, particle accelerators, generators, cryopumps, fusion devices, etc. and then through a Joule-Thompson valve 35, where a portion of the helium is liquified. The liquid helium is fed to bath 32. Return line 13 carries gaseous helium from above the liquid helium 31 in bath 32, back through heat exchangers 30, 28, 26, 24, 22, and 18 to provide heat removal from the helium in lines 17, 17A and 17B.

As an example of the operation of the process and apparatus of the invention, gaseous helium is compressed by compressor 11 from atmospheric pressure to a pressure of about 18 atmospheres. The output of the compressor, at a temperature in excess of about 300° K., is cooled to the range of about 80°–85° K. in heat exchangers 18 and 20 by the return stream, which is a temperature of about 80° K. at this point, and by liquid nitrogen at a temperature of about 78° K. The helium in line 17 is then cooled to around 30° K. by heat exchange in exchanger 22 with the return stream in line 13. After emerging from heat exchanger 22, the stream of helium is divided at point 14 with about one third of the total flow entering line 17A. The helium in line 17A then passes through expander 25 where the pressure is reduced to about 5.5 atmospheres and its temperature drops to around 22.5° K. Further cooling in heat exchangers 26 and 28 by the return stream in line 13, which is at a temperature of around 8° K. when it enters heat exchanger 28 reduces the temperature of the helium in line 17A to below 10° K. The other two thirds of the helium flow which is in line 17B is cooled by the return stream in heat exchangers 24 and 26 to about 12° K. and then passes through expander 27 where its pressure and temperature are reduced to about the same temperature and pressure as the helium in line 17A, or about 5 atmospheres and about 8° K.

It is important that the two streams be at about the same temperature and pressure in order to avoid a thermodynamic loss when they are recombined. The streams are recombined at point 16. The recombined stream in line 17 passes through heat exchanger 30, where it is further cooled by the return stream in line 13 to about 6° K. at a pressure of about 5 atmospheres, and then goes into cooling coil 29 in bath 32 where it is cooled to about 4.5° K. at a pressure of about 5 atmospheres. This cold supercritical gas stream is passed through load 33 where it absorbs heat from the load. The supercritical helium gas is then expanded through valve 35 where partial liquefaction takes place. The liquid helium is needed to replenish the helium 31 in bath 32 which is at a temperature of about 4.4° K. The gaseous helium above the liquid is then returned through the heat exchangers to cool the incoming helium stream in lines 17, 17A and 17B.

Table I provides the detailed heat balance for the cycle described above. In this example a 1 KW heat load is being absorbed by a helium stream flow of 138 gms/sec at a pressure of 4.89 atmospheres at a temperature between 4.5° and 5.79° K. The operating parameters of pressure, temperature, flow, entropy and enthalpy are given at the indicated points a to c′ on FIG. 1. These temperatures and pressures are varied to suit a particular application.

TABLE I

| Point | Temp. °K. | Press ATM | Enthalpy | Flow gm/sec | Entropy |
|---|---|---|---|---|---|
| a | 295.00 | 1.00 | 1547.00 | 138.489 | 31.32 |
| b | 295.00 | 1.00 | 1547.00 | 2.000 | 31.32 |
| c | 295.00 | 1.00 | 1547.00 | 136.489 | 31.32 |
| d | 303.00 | 18.00 | 1594.54 | 138.489 | 25.46 |
| e | 85.82 | 17.83 | 464.41 | 138.489 | 18.92 |
| f | 80.40 | 1.05 | 432.40 | 136.489 | 24.47 |
| g | 81.00 | 17.65 | 439.16 | 138.489 | 18.64 |
| h | 295.00 | 1.00 | 456.96 | 19.229 | 31.32 |
| i | 78.00 | 1.08 | 229.14 | 19.229 | 24.27 |
| j | 86.00 | 2.48 | 47.28 | 19.229 | 23.04 |
| k | 30.00 | 17.65 | 167.09 | 138.489 | 13.31 |
| l | 30.00 | 17.65 | 167.09 | 41.712 | 13.31 |
| m | 30.00 | 17.65 | 167.09 | 96.776 | 13.31 |
| n | 27.34 | 1.10 | 156.35 | 136.489 | 18.78 |
| o | 22.51 | 17.50 | 124.46 | 96.776 | 11.70 |
| p | 21.58 | 1.14 | 126.13 | 136.489 | 17.45 |
| q | 22.51 | 5.50 | 129.01 | 41.712 | 13.31 |
| r | 12.00 | 5.33 | 69.87 | 41.712 | 10.82 |
| s | 9.46 | 1.15 | 61.73 | 136.489 | 13.02 |
| t | 12.00 | 17.46 | 59.13 | 96.776 | 7.75 |
| u | 8.49 | 5.19 | 46.83 | 41.712 | 8.57 |
| v | 8.49 | 5.19 | 46.83 | 96.776 | 8.57 |
| w | 8.49 | 5.19 | 46.83 | 138.489 | 8.57 |
| x | 8.19 | 1.17 | 54.69 | 136.489 | 12.20 |
| y | 6.14 | 5.07 | 22.48 | 138.489 | 5.20 |
| z | 4.40 | 1.17 | 29.98 | 136.489 | 8.03 |
| a′ | 4.50 | 4.89 | 12.07 | 138.489 | 3.31 |
| b′ | 5.79 | 4.89 | 19.29 | 138.489 | 4.69 |
| c′ | 4.40 | 1.17 | 10.66 | 2.000 | 3.64 |

Figure 2:
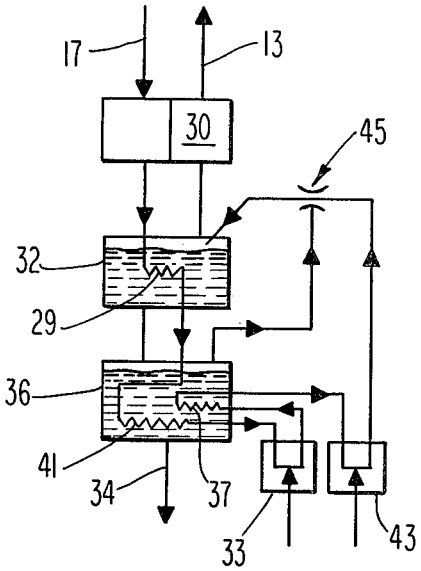
FIG. 2 is a schematic diagram illustrating an alternate embodiment of the refrigeration apparatus of the invention.

FIG. 2 illustrates an alternate embodiment of the invention. The system is the same through heat exchanger 30. The cooling of the refrigerative load is divided into two parts, 33 and 43, with intermediate subcooling in cooling coil 37 in bath 36. In the embodiment shown, two liquid helium cooling baths, 32 and 36, are provided with cooling coils 29 and 41. Dividing the cooling of the load into two or more parts reduces the temperature rise in each section giving an overall lower and more uniform operating temperature.

An ejector 45, which injects helium gas from above the liquid in bath 36 into the helium gas stream, is used here in order to further reduce the operating temperature and/or raise the compressor suction pressure. This reduces the compressor horsepower required. An ejector could also be used in the embodiment shown in FIG. 1.

The process and apparatus of the invention, by the manner in which the expanders are connected, provides the entire flow of the output of the compressor to the load and operates such that the compressor provides a forced flow of cooling medium through the load. A circulating pump which would add heat to the cycle is not needed to minimize the temperature rise through the load. The forced flow cooling enables refrigerative loads, such as large long horizontal magnets to be efficiently cooled where evaporative cooling or pool boiling techniques are impractical because of the load geometry which would require large numbers of cooling cans and associated piping.

I claim:

1. A closed loop, supercritical gas refrigeration apparatus comprising:
   a. Compressor means to compress a supply of gaseous material to superatmospheric pressure and to force the compressed gaseous material through a refrigerative load,
   b. high pressure fluid flow path means to convey substantially all of the compressed gaseous material from the compressor to the refrigerative load, said path means including;
      (1) means to divide the gaseous material into two streams,
      (2) means to expand the gaseous material in each stream,
      (3) means to recombine the two streams, and
      (4) means to pass the gaseous material through a cooling bath and the refrigerative load,
   c. means to expand and liquify a portion of the gaseous material after it has passed through the refrigerative load,
   d. means to introduce the liquid portion of the material into the cooling bath,
   e. low pressure fluid flow path means to return the expanded gaseous material from the liquid portion of the material in the cooling bath to the compressor, and
   f. heat exchange means arranged to provide heat transfer from the gaseous material flowing in the high pressure fluid flow path means to the gaseous material flowing in the low pressure fluid flow path means, such that the combination of the cooling of the gaseous material in the high pressure fluid flow by expansion, by heat exchange and by the cooling bath forms a stream of cold, supercritical gas which is passed through the refrigerative load.

2. The apparatus of claim 1 wherein the high pressure fluid flow path means includes means to pass the gaseous material through a portion of the load then back through the cooling bath and then through the remainder of the load.

3. The apparatus of claim 1 including a pair of cooling baths for the high pressure fluid flow path means located just prior to the load.

4. The apparatus of claim 1 including an ejector means for injecting gaseous material from above the liquid in the cooling bath into the gaseous material after it has been passed through the load so as to reduce the operating temperature and/or raise the suction pressure of the compressor means.

5. A supercritical gas refrigeration process which comprises:
   a. compressing a gas to form a gaseous feed stream at superatmospheric pressure,
   b. stepwise cooling the feed stream by heat exchange with a return stream of the gas,
   c. splitting the feed stream into two streams in the course of the stepwise cooling, and expanding gas in each stream to provide for the cooling of the gas while maintaining the gas at supercritical pressure,
   d. recombining the two streams at about the same temperature and pressure and passing the recombined feed stream through a cooling bath of liquified gas so as to further cool the gaseous feed stream,
   e. forcing substantially all of the cold, gaseous feed stream at supercritical pressure through a refrigerative load using the force provided by the initial compression,
   f. expanding the feed stream after passing through the load to partially liquify the gas in the feed stream,
   g. feeding the liquified gas to the cooling bath, and removing from above the bath to the return stream for compressing and return to the feed stream.

6. The process of claim 5 wherein the gas is helium.

7. The process of claim 5 wherein the gas is again cooled by passing the gas through a cooling bath after it has been passed through a portion of the refrigerative load.

8. The process of claim 5 including the step of injecting gas from above the bath into the gas stream after it has passed through the load.

9. The process of claim 5 including the steps of precooling the feed stream by heat exchange with liquid nitrogen.

10. The process of claim 5 including the steps of precooling the feed stream by expansion prior to splitting the feed stream.

* * * * *